United States Patent [19]

Jacoff

[11] Patent Number: 5,031,322

[45] Date of Patent: Jul. 16, 1991

[54] UTILITY KNIFE

[75] Inventor: Daniel Jacoff, New York, N.Y.

[73] Assignee: Great Neck Saw Manufacturers, Inc., Mineola, N.Y.

[21] Appl. No.: 519,782

[22] Filed: May 7, 1990

Related U.S. Application Data

[63] Continuation-in-part of Ser. No. 337,479, Apr. 13, 1989, Pat. No. 4,930,218.

[51] Int. Cl.[5] ..... B26B 5/00; B26B 1/00; B26B 17/00

[52] U.S. Cl. ..... 30/162; 30/320; 30/331

[58] Field of Search ..... 30/160, 161, 162, 320, 30/331, 335; 292/80, 87, 254, 253, 256.75

[56] References Cited

U.S. PATENT DOCUMENTS

| | | | |
|---|---|---|---|
| 2,010,304 | 8/1935 | Hyatt | 30/331 |
| 2,527,711 | 10/1950 | Davidson, Jr. | 292/80 |
| 4,063,356 | 12/1977 | Hepworth | 30/320 |
| 4,240,202 | 12/1980 | Gilbert | 30/162 |
| 4,586,256 | 5/1986 | Weimann | 30/320 |
| 4,621,425 | 11/1986 | Stoutenberg | 30/320 |
| 4,663,845 | 5/1987 | Weimann | 30/320 |
| 4,730,731 | 3/1988 | Allison | 272/87 |

*Primary Examiner*—Douglas D. Watts
*Assistant Examiner*—Paul M. Heyrana, Sr.
*Attorney, Agent, or Firm*—Stoll, Previto & Hoffman

[57] ABSTRACT

A utility knife having a main body formed from a pair of body halves which are assembled together. The main body has an opening at the front with means to prevent the pair of body halves from spreading apart and with means to prevent the blade from swaying from side to side. In addition, means are provided to hold the body halves together without the necessity of using special tools or fastening means.

14 Claims, 3 Drawing Sheets

UTILITY KNIFE

RELATED CASE

This application is a continuation-in-part of U.S. patent application Ser. No. 337,479 filed Apr. 13, 1989, now U.S. Pat. No. 4,930,218, dated Jun. 5, 1990.

BACKGROUND

The present invention relates to a utility knife and more particularly to a utility knife which has a knife blade extending from its forward end.

In the past, utility knives have been assembled from two matching halves within which there is provided a knife blade. The two matching halves are adapted to interfit with each other to form the body of the tool and to be held together by any suitable means, such as screws. The two matching halves have spaces at their front ends in order to form an open mouth. Mounted within the matching halves of some utility knives is a blade carrier which is adapted to move forwardly in order to project the blade through the front open mouth to permit the tool to be used and to move backwardly to retract the blade within the two matching portions when the tool is no longer in use. In other utility knives presently in use, the blade is not retractable but is permanently held in either the extended position or the retracted position.

One of the problems in this type of a structure is that the front ends of the two matching portions which form the mouth tend to spread out when the tool is being used. This spreading action may not only prevent the tool from making an accurate cut, but, more importantly, may also allow the blade to be forced out of the front end of the tool to cause possible injury to the user.

Another problem with existing tools is the fact that the utility tool may not hold the blade firmly in place until the two halves are permanently secured together. This results in fluctuation of the two halves of the tool which can cause injury or prevent the knife from making a proper cut. Moreover, in some tools, and especially those in which the blade is not retractable, there are no means to properly hold the two halves together until the permanent attachment means are in place so that there may be misalignment of the blade.

In some utility knives the front end of the mouth is anchored, the other parts of the two halves are not anchored and must be held together by a screw. This requires the user to manually hold the two halves together until a screw is threaded through the two halves.

U.S. Pat. Nos. 3,872,591; 4,761,882; 4,240,202; 4,603,356; and 2,467,481 disclose a variety of utility knives in the prior art.

OBJECTS

The present invention avoids these drawbacks and has for one of the objects the provision of an improved utility knife in which means are provided whereby the knife is held in a steady position at the mouth and cannot fluctuate from side to side.

Another object of the present invention is the provision of a utility knife in which the two halves are two matching one piece units which can be easily assembled together.

Another object of the present invention is the provision of an improved utility knife in which the blade is not retractable but which is permanently in place in either the extended or the retracted position.

Another object of the present invention is the provision of an improved utility knife in which means are provided for securing the rear or other portions of the two halves together to prevent fluctuation.

Another object of the present invention is a provision of the improved utility knife in which means are provided whereby the two halves are interlocked with each other at the mouth in order to prevent them from spreading apart.

Another object of the present invention is the provision of an improved utility knife in which the two halves are easily held in alignment until the permanent attachment means are in place.

Another object of the present invention is the provision of an improved utility knife in which the rear, or some other portion of the two halves, can be locked together without the use of any special tools.

Another object of the present invention is the provision of an improved utility knife in which both the front and rear portions as the two halves are locked together without the use of any special tools.

Other and further objects of the invention will be obvious upon an understanding of the illustrative embodiment about to be described or will be indicated in the appended claims, and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification wherein.

DESCRIPTION

Figure 1:
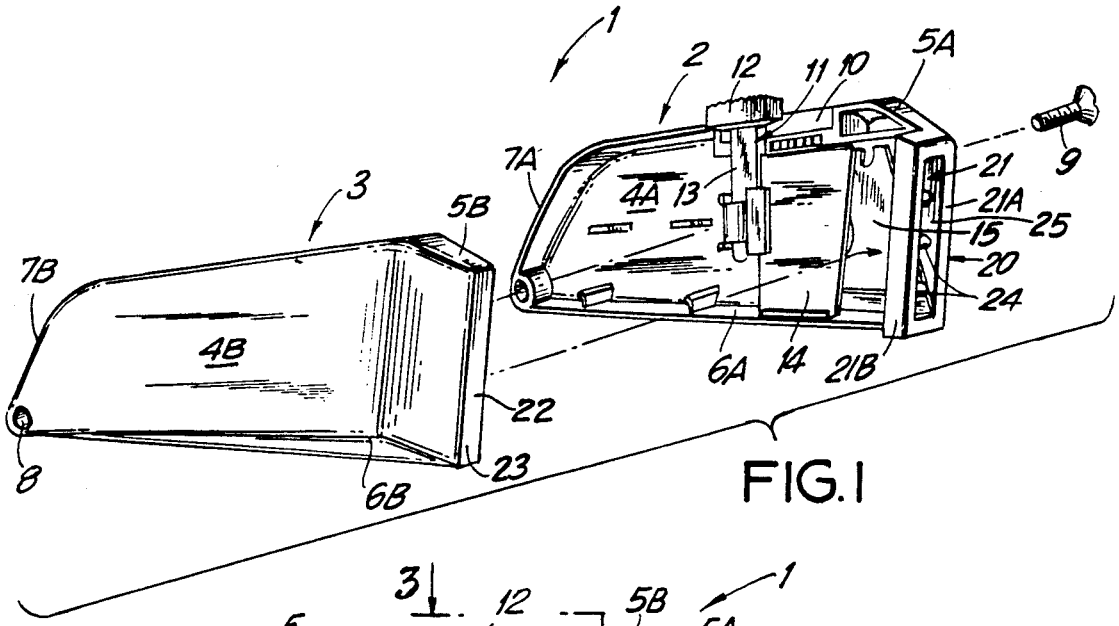
FIG. 1 is an exploded perspective view showing a utility knife made in accordance with the present invention.
Figure 2:
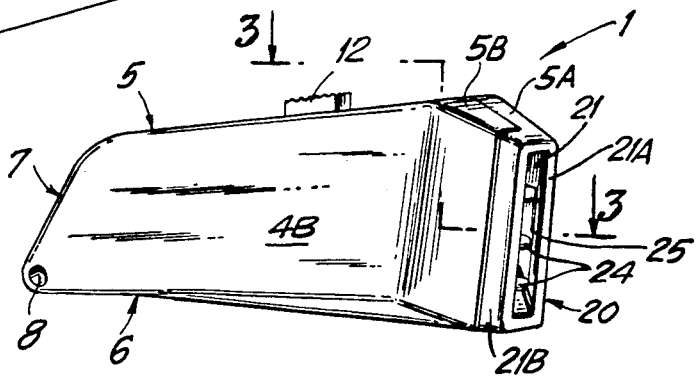
FIG. 2 is a perspective view of the assembled utility knife of FIG. 1.
Figure 3:
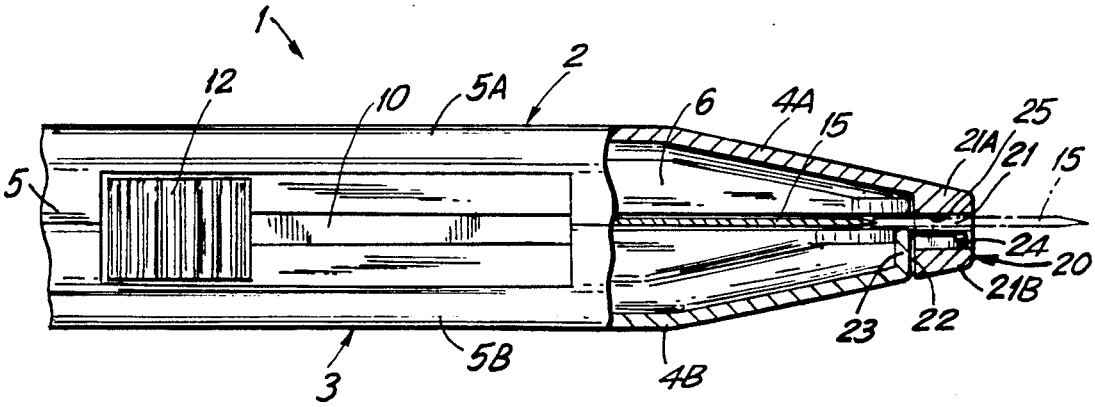
FIG. 3 is a sectional view taken along line 3—3 of FIG. 2.

Referring to the drawings, and more particularly to FIGS. 1-3, the utility knife 1 is made from two matching halves 2-3 having side walls 4A-4B. The halves 2-3 are also provided with top walls 5A-5B, bottom walls 6A-6B and rear walls 7A-7B—each of which will be collectively referred to as the top wall 5, bottom wall 6 and rear wall 7, respectively, when the two halves 2-3 are assembled together to form the utility knife body 1, as shown in FIG. 2.

Both halves 2-3 have means (not shown) adapted to receive a screw 9, or some other fastening device, to permit the two halves 2-3 to be held together when assembled to form the utility knife body 1. The rear wall 7A-7B of both halves 2-3 may also have an opening 8 to permit the tool to be hung when not in use.

The upper wall 5 of the body 1 has an elongated slot 10 therein in order to accommodate a blade carrier 11. In the particular embodiment shown in FIGS. 1-3 of the drawings, the blade carrier 11 has a finger knob 12 extending above the slot 10 with a pusher shaft 13 extending within the slot and within the interior of the body 1. The pusher shaft 13 has the blade holder 14 at its front end adapted to hold a trapezoidially-shaped knife blade 15 securely therein. It will be noted that by moving the finger knob 12 forwardly and backwardly, the blade 15 is projected forwardly or retracted backwardly.

At the front end of the body half 2, there is provided a front wall 20 at right angles to the side wall 4A having an elongated front opening therein forming a mouth 21 comprising mouth walls 21A and 21B. It will be noted that the width of the mouth 21 is much larger than the thickness of the blade 15 so that when the blade 15 is projected through the mouth 21, a space 25 is left between the blade 15 and the mouth wall 21B of the mouth 21 (FIG. 3).

The fingers 24 preferably comprise a plurality of horizontally oriented spaced fingers which are integral with the inner side wall of the mouth 21B and extend into the space 25. The fingers 24 terminate short of the opposite wall of the mouth 21A and leave sufficient space for the blade 15 to move between the fingers 24 and the opposite wall of the mouth 21A. Hence, when the blade 15 is in the extended position as shown in FIG. 3, the blade 15 will not wobble or sway from side to side.

It will be understood that the use of spaced fingers 24 is the preferred embodiment of the invention. It is possible to achieve the same result by using a solid plate rather than spaced fingers 24 or to have fingers 24 in a different orientation than the ones shown in the drawing or to merely have a plurality of protrusions extending from the side wall 21B.

The other body half 3 has a solid front wall 23 extending at right angles to the side wall 4B. The front wall 23 is adapted to abut against the rear edge 22 of the mouth 21 which acts as a stop to accurately place the wall 4B in the proper position with respect to side wall 4A so that the two may be assembled together.

As discussed above and as will be seen from FIG. 3, since the fingers 24 fit into and fill the space 25 of the mouth 21, sufficient room is left for the blade 15 to move in and out of the mouth 21 without any obstructions. However, the space between mouth wall 21A and the fingers 24 is narrow enough for the blade 15 to remain steady while in use without bending or angling.

In operation, the two body portions 2 and 3 are mounted together and held by a screw 9 as shown in FIGS. 1 and 2 to form the body of the utility knife 1. The front wall 23 abuts rear edge 22 of the mouth portion 21B so that it cooperates therewith to properly position the half 4B.

When in use, the blade 15 is moved forwardly and outwardly through the finger knob 12 and moves between the fingers 24 and the mouth wall 21A and is held steady in that position. Since the front mouth 21 of the body portion 4A cannot spread, there is no danger that the front areas of the mouth will spread apart and cause the blade 15 either to make an improper cut or be accidentally forced out of the body. When the user finishes using the utility knife, the blade 15 is retracted within the body 1.

Figure 4:
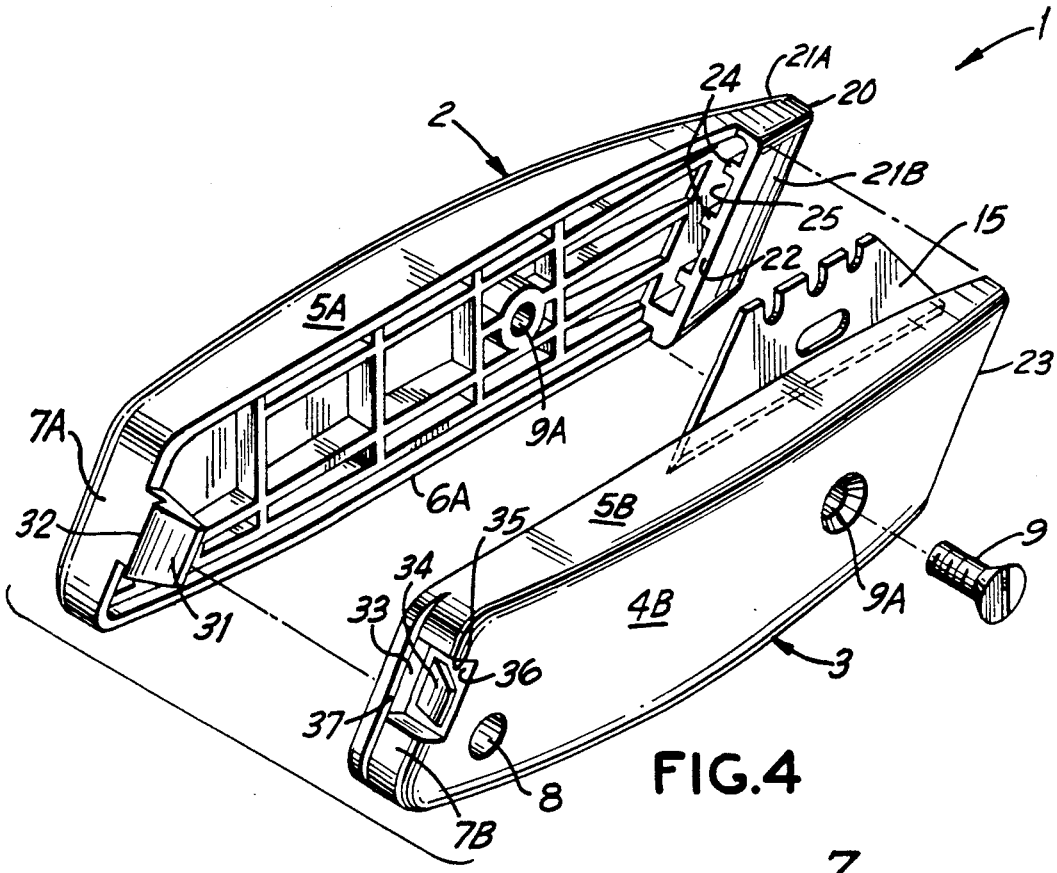
FIG. 4 is an exploded perspective view showing another embodiment of the utility knife of the present invention.
Figure 5:
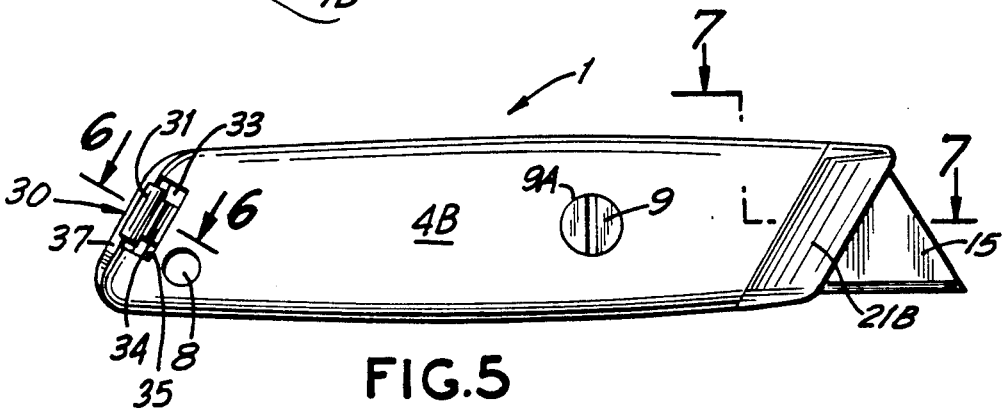
FIG. 5 is a side view thereof.
Figure 6:
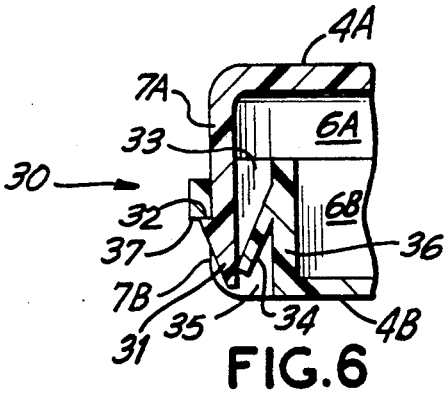
FIG. 6 is a sectional view taken along line 6—6 of FIG. 5.
Figure 7:
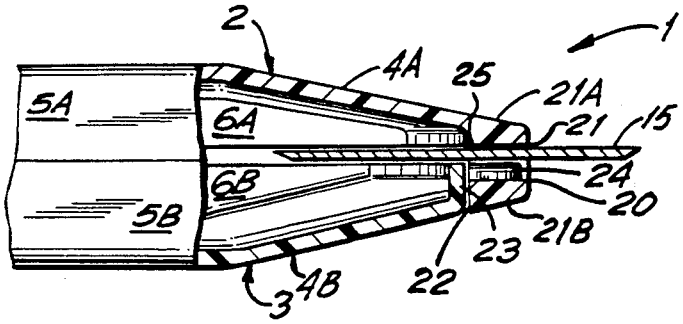
FIG. 7 is a sectional view taken along line 7—7 of FIG. 5.

Referring to the embodiment shown in FIGS. 4-7, for simplicity, parts in this embodiment which are the same as like parts in the embodiment of FIGS. 1-3 will be labeled with the same reference numbers. The utility knife 1 is made from two matching halves 2-3 having side walls 4A-4B. The halves 2-3 are also provided with the top walls 5A-5B, bottom walls 6A-6B and rear walls 7A-7B —each of which will be collectively referred to as the top wall 5, bottom wall 6, and rear wall 7, respectively, when the two halves 2-3 are assembled together to form the utility knife body 1 as shown in FIGS. 5-7.

Both halves 2-3 have openings 9A adapted to receive a screw 9, or some other fastening device, to permit the two halves 2-3 to be held together when assembled to form the utility knife body 1. The rear wall 7A-7B of both halves 2-3 may also have an opening 8 to permit the tool to be hung when not in use.

The blade 15 in this embodiment is shown as not being retractable. The blade 15 shown in FIGS. 4-7 is manually positioned so that it lies between the two halves 2-3 by first opening the two halves 2-3, positioning the blade in the desired position (extended or retracted) and thereafter closing the two halves 2-3. However, it will be understood that the improvements in the utility knife described in this embodiment of the present invention may be used with retractable blade 15 if desired.

At the front end of the body half 2, there is provided a front wall 20 at right angles to the side wall 4A having an elongated front opening therein forming a mouth 21 comprising spaced and opposed mouth walls 21A and 21B. It will be noted that the width of the mouth 21 is much larger than the thickness of the blade 15 so that when the blade 15 projecting through the mouth 21, a space 25 is left between the blade 15 and the mouth wall 21B of the mouth 21 (FIG. 7).

The fingers 24 preferably comprise a plurality of horizontally-oriented spaced fingers which are integral with the inner side wall of the mouth 21B and extend into the space 25. The fingers 24 terminate short of the opposite wall of the mouth 21A and leave sufficient space for the blade 15 to lie between the fingers 24 and the opposite wall of the mouth 21A. Hence, the blade 15 will not wobble or sway from side to side.

As set forth in connection with the embodiment described in FIGS. 1-3 above, the use of spaced fingers 24 is the preferred embodiment of the invention. It is possible to achieve the same result by using a solid plate rather than spaced fingers 24 or to have fingers 24 in a different orientation than the ones shown in the drawing or to merely have a plurality of protrusions extending from the side wall 21B.

The other body half 3 has a solid front wall 23 extending at right angles to the side wall 4B. The front wall 23 is adapted to abut against the rear edge 22 of the mouth 21 which acts as a stop to accurately place the wall 4B in the proper position with respect to side wall 4A so that the two may be assembled together.

As will be seen from FIG. 7, the blade 15 lies between the fingers 24 and the mouth wall 21A. Since the fingers 24 fit into and fill the space 25 of the mouth 21, sufficient room is left for the blade 15 to lie in the mouth 21 without any obstructions. However, the space between mouth wall 21A and the fingers 24 is narrow enough for the blade 15 to remain steady while in use without bending or angling.

As shown in the drawings, the rear walls 7A and 7B are provided with a snap lock assembly 30 which permits the two halves 2-3 of the tool 1 to be snapped together. This is useful in keeping the halves 2-3 steady and together after the blade 15 has been properly positioned and until the permanent screw 9 is in place. One of the rear walls 7A, is provided with a resilient tongue 31 extending therefrom. The tongue 31 has a lock shoulder 32 therein. The other wall 7B has an opening 33 therein communicating with a notch 35 adapted to receive the tongue 31 therein. The opening 33 has a resilient push finger 34 which extends from its wall 36 into the notch 35 to bear against the tongue 31 after the lock surface 32 snaps under a lock surface 37 formed in the rear wall 7B (FIG. 6) in order to hold the tongue 31 in place.

When the two halves 2-3 are mounted together the blade 15 is manually placed either in its retracted position within the confines of the two halves 2-3 or in its extended operative position (FIGS. 5 and 7). The two halves 2-3 are then manually brought together and the rear snap lock assembly 30 permits the two halves to be placed together and held in place until the screw 9 can be affixed to permanently hold the two halves 2-3 together. This prevents any misalignment of the two halves 2-3 until the two halves are permanently mounted together. This also prevents the blade 15 from slipping out till the two halves are permanently mounted together.

In order to operate the snap lock assembly 30, the tongue 31 is moved through the opening 33 of the other half against the pressure of the push finger 34 until the shoulder 32 in the tongue 31 clears the shoulder 37 in the rear wall 7B, at which time the pressure of the push finger 34 moves tongue 31 rearwardly until its shoulder 32 moves under the shoulder 37 in order to lock the two halves 2-3 in place. They remain in this position by the pressure of the push finger 34 applying pressure against the tongue 31 to keep it in the locked position.

When it is desired to open the two halves 2-3 in order to change the position of the blade 15, or for some other reason, the screw 9 is removed and the tongue 31 is pressed inwardly against the pressure of the push finger 34 until its shoulder 32 clears the shoulder 37 on the rear wall 7B so that the tongue 31 may be moved out of the opening 33 in order to unlock the two halves 2-3.

In operating the embodiment shown in FIGS. 4-7, the two body portions 2 and 3 are mounted together as shown in FIGS. 1 and 2 to form the body of the utility knife 1 after the blade 15 is now placed in its extended position as shown in FIGS. 4 and 7. The front wall 23 abuts rear edge 22 of the mouth portion 21B so that it cooperates therewith to properly position the half 4B. The blade 15 lies between the fingers 24 and the mouth wall 21A and is held steady in that position. Since the front mouth 21 of the body portion 4A cannot spread, there is no danger that the front areas of the mouth will spread apart and cause the blade 15 either to make an improper cut or be accidentally forced out of the body.

When it is desired to remove the blade 15 from its extended position, the screw 9 is first removed. The rear tongue 31 is pressed inwardly against the pressure of the push finger 34 until the shoulder 32 clears the shoulder 37 so that the tongue 31 may be removed from the rear opening 33 and the two halves 2-3 taken apart and the blade 15 removed.

While the snap lock assembly 30 has been shown as being located on the rear walls 7A-7B of the two halves 2-3, it will be understood that the snap lock assembly 30 may be located at any other place on the two halves 2-3 without departing from the invention. It also will be understood that while a single snap lock assembly has been shown and described, it is within the scope of the present invention to use more than one snap lock assembly 30.

Figure 8:
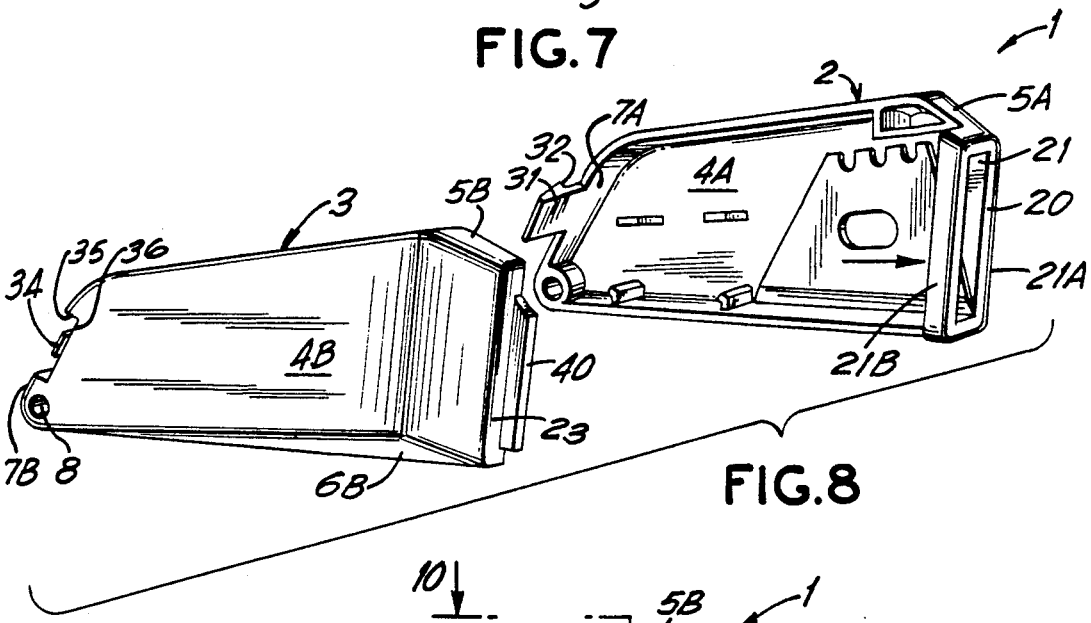
FIG. 8 is an exploded perspective view showing another embodiment of a utility knife made in accordance with the present invention.
Figure 9:
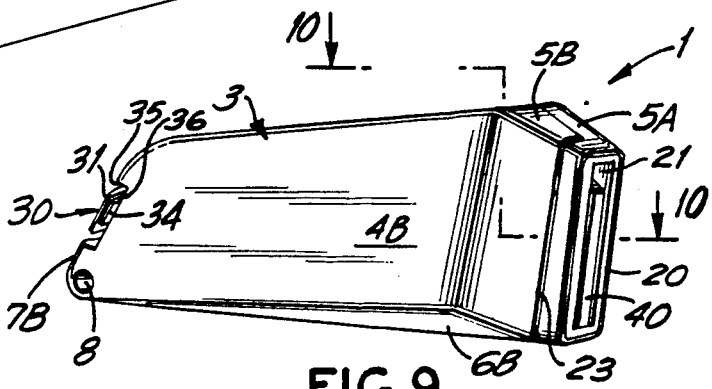
FIG. 9 is a perspective view of the assembled utility knife of FIG. 8.
Figure 10:
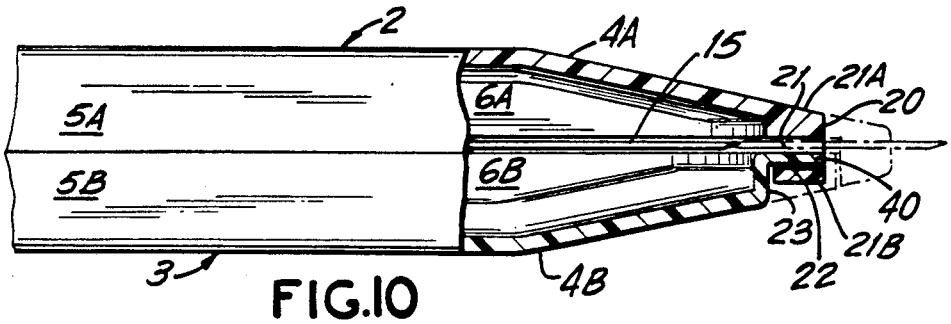
FIG. 10 is a sectional view taken along line 10—10 of FIG. 2.

Referring to the embodiment of FIGS. 8-10, for simplicity, parts in this embodiment which are the same as like parts in the embodiments of FIG. 1-77 will be labeled with the same reference numbers. The utility knife 1 is made from two matching halves 2-3 having side walls 4A-4B. The portions are also provided with top walls 5A-5B, bottom walls 6A-6B and rear walls 7A-7B—each of which will be collectively referred to as the top wall 5, bottom wall 6 and rear wall 7, respectively, when the two halves 2-3 are assembled together to form the utility knife body 1 as shown in FIGS. 9 and 10.

At the front end of the body half 2, there is provided a front wall 20 at right angles to the side wall 4A having an elongated front opening therein forming a mouth 21 comprising mouth walls 21A and 21B. It will be noted that the width of the mouth 21 is much larger than the thickness of the blade 15 so that when the blade 15 projects through the mouth 21 (shown in broken lines in FIG. 10), a space 22 is left between the blade 15 and the mouth wall 21B of the mouth 21.

The other body half 3 has a solid front wall 23 extending at right angles to the side wall 4B with a finger 40 extending forwardly therefrom. The finger 40 is adapted to be inserted into the open mouth 21 adjacent mouth wall 21B in order to permit the finger to interlock with the open mouth 21 as shown in greater detail in FIG. 10. It will be seen from FIG. 10 that the lock finger 40 fits into and fills the space 22 of the mouth 21 and engages the mouth wall 21B. This leaves sufficient room for the blade 15 either lie in mouth 21 without any obstructions or to move in and out of mouth 21 without obstruction if the blade 15 is retractable. In addition, it will be noted that the space between mouth wall 21A and the lock finger 40 is narrow enough for the blade 15 to remain steady while in use without bending or angling.

As shown in the drawings, the rear walls 7A and 7B are provided with a snap lock assembly 30 which permits the two halves 2-3 of the tool 1 to be snapped together. The snap lock assembly 30 shown and disclosed in this embodiment is substantially identical to the snap lock assembly 30 shown and disclosed in this embodiment of FIGS. 4-7. The snap lock assembly 30 will lock the halves 2-3 together after the blade 15 has been properly positioned and the front portion of the two halves interlocked by the finger 40 entering the mouth 21. One of the rear walls 7A is provided with a resilient tongue 31 extending therefrom. The tongue 31 has a lock shoulder 32 therein. The other wall 7B has an opening 33 therein communicating with a notch 35 adapted to receive the tongue 31 therein (FIGS. 4-6). The opening 33 has a resilient push finger 34 which extends from its wall 36 into the notch 35 to bear against the tongue 31 after the lock surface 32 snaps under a lock surface 37 formed in the rear wall 7B (FIG. 6) in order to hold the tongue 31 in place (FIGS. 4-6).

When the two halves 2-3 are mounted together the blade 15 is placed either in its retracted position within the confines of the two halves 2-3 or in its extended operative position. The front finger 40 is inserted into the mouth 21 and the rear snap lock assembly 30 permits the two halves to be held in place to permanently hold the two halves 2-3 together.

In order to operate the snap lock assembly 30, the tongue 31 is moved through the opening 33 of the other half against the pressure of the push finger 34 until the shoulder 32 in the tongue 31 clears the shoulder 37 in the rear wall 7B, at which time the pressure of the push finger 34 moves tongue 31 rearwardly until its shoulder 32 moves under the shoulder 37 in order to lock the two halves 2-3 in place. They remain in this position by the pressure of the push finger 34 applying pressure against the tongue 31 to keep it in the locked position.

When it is desired to open the two halves 2-3 in order to change the position of the blade 15 or for some other reason, the tongue 31 is pressed inwardly against the pressure of the push finger 34 until its shoulder 32 clears the shoulder 37 of the rear wall 7B so that the tongue 31 may be moved out of the opening 33 in order to unlock the two halves 2-3. The finger 40 is then moved out of the mouth 21.

In operating the embodiment shown in FIGS. 8-10, the two body halves 2-3 are mounted together as shown in FIGS. 4 and 7. The front wall 23 abuts rear edge 22 of the mouth portion 21B so that it cooperates therewith to properly position the half 4B. The blade 15 lies between the finger 40 and the mouth wall 21A and is held steady in that position. Since the front mouth 21 of the body portion 4A cannot spread, there is no danger that the front areas of the mouth will spread apart and cause the blade 15 either to make an improper cut or be accidentally forced out of the body.

When it is desired to remove the blade 15 from its extended position, the rear tongue 31 is pressed inwardly against the pressure of the push finger 34 until the shoulder 32 clears the shoulder 37 so that the tongue 31 may be removed from the rear opening 33 and the two halves 2-3 taken apart and the blade 15 removed.

While the snap lock assembly 30 has been shown as being located on the rear walls 7A-7B of the two halves 2-3, it will be understood that the snap lock assembly 30 may be located at any other place on the two halves 2-3 without departing from the invention. It also will be understood that while a single snap lock assembly has been shown and described, it is within the scope of the present invention to use more than one snap lock assembly 30.

In operation, the two body halves 2 and 3 are mounted together and the finger 40 of the body half 3 is inserted within the mouth 21 of the body half 2 so that it cooperates with the mouth wall 21B to interlock the body halves 2 and 3 together at the front mouth area so that the front portion of the utility knife 1 does not spread out.

The blade 15 either is placed in the extended or retracted position either by moving between the finger 40 and the mouth wall 21A (if the blade is retractable), or remaining in either position if the blade is not retractable. In either case, the blade 15 is held steady in that position. Since the front mouth areas of the body halves 2-3 are held interlocked together in the position shown in FIG. 10, there is no danger that the front areas of the mouth will spread apart and cause the blade 15 either to make an improper cut or be accidentally forced out of the body.

It will thus be seen that the present invention provides an improved utility knife which prevents the front of the mouth-forming portions from spreading apart, in which the two halves are interlocked with each other in order to prevent them from spreading apart and to keep the two halves in place while the two halves are permanently mounted together and in which the two halves may be easily assembled together.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A utility knife for holding a blade comprising a main body formed from a pair of separate and unattached body halves assembled together, said main body having an opening at the front to accommodate a blade and a pair of locking means in spaced relationship to each other relative to said body halves cooperating with each other to removably hold the two body halves together, one of said locking means comprises a snap lock assembly to hold the two halves together and the other of said locking means is provided adjacent the front opening to prevent the body halves at the front from spreading apart.

2. A utility knife as claimed in claim 1 wherein said snap lock assembly comprises a lock tongue extending from one of said halves and an opening in the other of said halves, said lock tongue being insertable into said opening.

3. A utility knife as claimed in claim 2 wherein said opening is located in a notch having a resilient push finger extending from a wall thereof and adapted to apply pressure to the lock tongue.

4. A utility knife as claimed in claim 3 wherein said notch has a lock surface and the lock tongue is provided with a lock surface which engages the lock surface on the notch.

5. A utility knife as claimed in claim 4 wherein said snap lock assembly is provided substantially toward the rear of the two halves.

6. A utility knife as set forth in claim 1 wherein said front opening comprises a mouth having a pair of opposed mouth side walls, said mouth extending at right angles from one of said body portions, one of said opposed mouth side walls being mounted on the same body portion from which said mouth extends, and means from one mouth wall extending into said mouth to restrict the space within the mouth.

7. A utility knife as set forth in claim 6 wherein said restricting means comprises a finger extending from one side wall of the mouth.

8. A utility knife as set forth in claim 7 wherein a plurality of fingers is provided.

9. A utility knife as set forth in claim 8 wherein a knife blade is retractably mounted within the main body and is moved between the fingers and the other side wall of said open mouth.

10. A utility knife as set forth in claim 1 wherein said other locking means comprise interlocking mechanism at said mouth.

11. A utility knife as set forth in claim 10 wherein said interlocking mechanism is mounted on said body halves.

12. A utility knife as set forth in claim 11 wherein said interlocking mechanism comprises a mouth having a pair of side walls extending at right angles from one of said body halves.

13. A utility knife as set forth in claim 12 wherein said interlocking mechanism comprises a lock finger extending from the other body half and mounted within said open mouth.

14. A utility knife as set forth in claim 13 wherein said lock finger abuts one of the side walls of said mouth.

* * * * *